US007004332B2

(12) United States Patent
Davis

(10) Patent No.: US 7,004,332 B2
(45) Date of Patent: Feb. 28, 2006

(54) ARTICULATING DISC SCREEN APPARATUS FOR RECYCLABLE MATERIALS

(75) Inventor: Robert M. Davis, Jamul, CA (US)

(73) Assignee: CP Manufacturing, Inc., National City, CA (US)

( * ) Notice: Subject to any disclaimer, the term of this patent is extended or adjusted under 35 U.S.C. 154(b) by 464 days.

(21) Appl. No.: 10/044,222

(22) Filed: Nov. 21, 2001

(65) Prior Publication Data

US 2003/0116486 A1 Jun. 26, 2003

(51) Int. Cl.
*B07B 13/05* (2006.01)

(52) U.S. Cl. ..... 209/672; 209/667; 209/660; 209/314; 209/354; 198/382

(58) Field of Classification Search ..... 209/671, 209/672, 667, 260, 319, 413, 930, 931
See application file for complete search history.

(56) References Cited

U.S. PATENT DOCUMENTS 2,055,630 A * 9/1936 McClean ..... 19/65 R
4,377,474 A 3/1983 Lindberg ..... 209/279
4,755,286 A 7/1988 Bielagus ..... 209/243
4,836,388 A * 6/1989 Bielagus ..... 209/672
5,480,034 A * 1/1996 Kobayashi ..... 209/667
5,626,239 A * 5/1997 Kobayashi ..... 209/667
6,234,322 B1 * 5/2001 Paladin ..... 209/667
6,250,478 B1 * 6/2001 Davis ..... 209/672
6,318,560 B1 * 11/2001 Davis ..... 209/672
6,460,706 B1 * 10/2002 Davis ..... 209/672
6,648,145 B1 * 11/2003 Davis et al. ..... 209/672

* cited by examiner

*Primary Examiner*—Donald P. Walsh
*Assistant Examiner*—Jonathan R. Miller
(74) *Attorney, Agent, or Firm*—Michael H. Jester

(57) ABSTRACT

A disc screen apparatus for classifying a stream of mixed recyclable materials of various sizes and shapes, including newspaper, clean mixed paper, magazines, plastic bottles, glass bottles and jars, cans, and the like. The apparatus has an inclined fixed first disc screen section and an inclined articulating second disc screen section whose angle of inclination can be independently adjusted via a hydraulic cylinder or other angular adjustment mechanism in order to improve the separation of newspaper and/or clean mixed paper without impairing the ability of the fixed disc screen section to separate mixed containers. The first and second disc screen sections are supported by first and second frames that carry the parallel driven shafts and discs that form the disc screen sections. The frames have complementary mating surfaces that limit the range of articulation of the second disc screen section.

18 Claims, 2 Drawing Sheets

ARTICULATING DISC SCREEN APPARATUS FOR RECYCLABLE MATERIALS

FIELD OF THE INVENTION

The present invention relates to machines for processing mixed recyclable materials, and more particularly, to disc screen apparatus suited for separating newspaper and/or clean mixed paper from a stream of mixed recyclable materials.

BACKGROUND OF THE INVENTION

Material recycling has become an important industry in recent years due to decreasing landfill capacity, environmental concerns and dwindling natural resources. Many industries and communities have adopted voluntary and mandatory recycling programs for reusable materials. Solid waste and trash that is collected from homes, apartments and companies often combine several recyclable materials into one container. When brought to a processing center, the recyclable materials are frequently mixed together in a heterogenous mass of material. Mixed recyclable materials include newspaper, clean mixed paper, magazines, aluminum cans, plastic bottles, glass bottles and other materials that may be recycled.

Disc apparatus or "disc screens" are increasingly used to separate streams of mixed recyclable materials into respective streams or collections of similar materials. This process is referred to as "classifying", and the results are called "classification". A disc screen typically includes a frame in which a plurality of rotatable shafts are mounted in parallel relationship. A plurality of discs are mounted on each shaft and a chain drive commonly rotates the shafts in the same direction. The discs on one shaft interleave with the discs on each adjacent shaft to form screen openings between the peripheral edges of the discs. The size of the openings determines the dimension (and thus the type) of material that will fall through the screen. Rotation of the discs, which have an irregular outer contour, agitates the mixed recyclable materials to enhance classification. The rotating discs propel the larger articles which are too big to fall between the discs across the screen. The general flow direction extends from an input area where the stream of material pours onto the disc screen to an output where the larger articles pour off of the disc screen. The smaller articles fall between the discs onto another disc screen or a conveyor, or into a collection bin.

There is a substantial market for recycled newspaper and/or clean mixed paper. Therefore, it is important that any disc screen which is designed to classify mixed recyclable materials be capable of thoroughly separating newspaper and/or clean mixed paper from the heterogenous mass of material. Prior disc screen apparatus designed to handle a stream of mixed recyclable materials have included multiple disc screens with different fixed angles of inclination and different sizes of openings between the discs. They are capable of separating broken glass from containers. They are also capable of separating clean mixed paper and newspaper from the stream of mixed recyclable materials. CP Manufacturing, Inc. of National City, Calif., the assignee of the subject application, sells the NEWScreen™ recyclable waste classifier with multiple overlapping screens that can be simultaneously tilted at various angles to improve the efficiency of separation of mixed recyclable materials. See U.S. Pat. No. 6,250,478 granted Jun. 26, 2001 to Robert M. Davis and entitled "Stepped Disc Screens of Unequal Inclination Angles for Conveying and Grading Recycling Materials." However, a consistent problem that has been encountered with apparatus for classifying mixed recyclable materials using multiple disc screens is the fact that all of the disc screens must be tilted together. This may improve the separation on one of the screens while impairing the separation on the other screen(s).

In order to overcome these drawbacks, recycling apparatuses have been constructed with a pair of disc screens, one feeding the next, with the angle of each screen being independently adjustable. The output end of the first screen is spaced a considerable distance above the input end of the second screen. Where such apparatuses are used to classify mixed recyclable materials there are inefficiences that result from the waste having to spill off the upper end of one screen onto the lower end of the next screen. Also, the disc spacings and contours may vary between the screens further reducing the efficiency of the overall classification. If the first screen is too steeply angled, newspaper will fall off its rearward end along with containers and this is undesirable. If the first screen is not inclined enough, then the containers will not fall off its rearward end and this is also undesirable. Furthermore, the use of two tiered or overlapping screens necessarily increases the overall size, cost and complexity of this type of waste sorting apparatus.

SUMMARY OF TILE INVENTION

The present invention provides a disc screen apparatus for classifying a stream of mixed recyclable materials of various sizes and shapes, including newspaper, clean mixed paper, magazines, plastic bottles, glass bottles and jars, cans, and the like. The apparatus has an inclined fixed first disc screen section and an inclined articulating second disc screen section whose angle of inclination can be independently adjusted via a hydraulic cylinder or other angular adjustment mechanism in order to improve the separation of newspaper and clean mixed paper without impairing the ability of the fixed screen section to separate mixed containers. The first and second disc screen sections are supported by first and second frames that carry the parallel driven shafts and discs that form the screen sections. The frames may have complementary mating surfaces that limit the range of articulation of the second screen section. The input end of the second disc screen section is positioned immediately adjacent the output end of the first disc screen section for receiving a portion of the mixed recyclable materials therefrom. The fixed first frame may contain a third disc screen section with an output end positioned above the first disc screen section and a fourth disc screen section positioned beneath the third disc screen section.

The present invention also provides a method of classifying mixed recyclable materials containing paper and containers. In accordance with the first step of the method, a single continuous inclined disc screen is provided having a plurality of discs with irregular outer contours which are supported on parallel shafts spaced along a conveying direction. The shafts are rotated and mixed recyclable materials are deposited onto the rotating discs. An angle of inclination of a downstream section of the disc screen is adjusted relative to an upstream section of the disc screen in order to ensure that mostly containers fall off an input end of the disc screen and mostly paper falls off an output end of the disc screen.

DESCRIPTION OF THE PREFERRED EMBODIMENTS

Figure 1A:
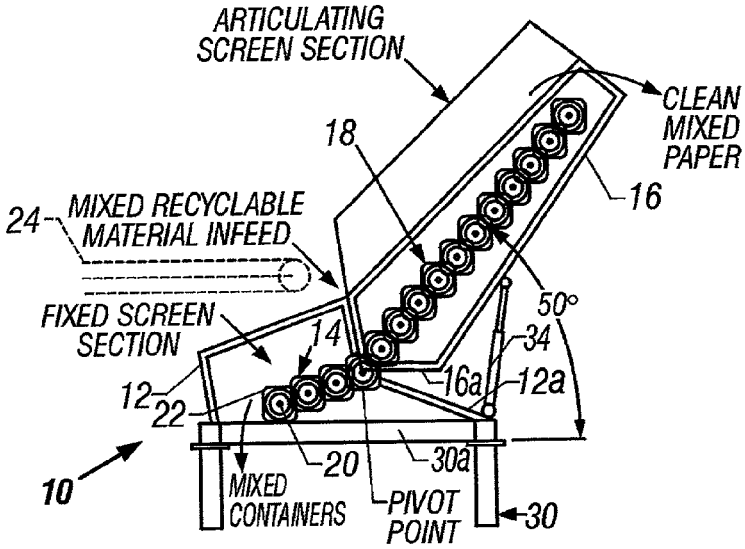
FIGS. 1A, 1B and 1C are a series of diagrammatic cut away side elevation views illustrating a recycling apparatus in accordance with a first embodiment of the present invention showing its downstream articulating disc screen section in various angular orientations.
Figure 1B:
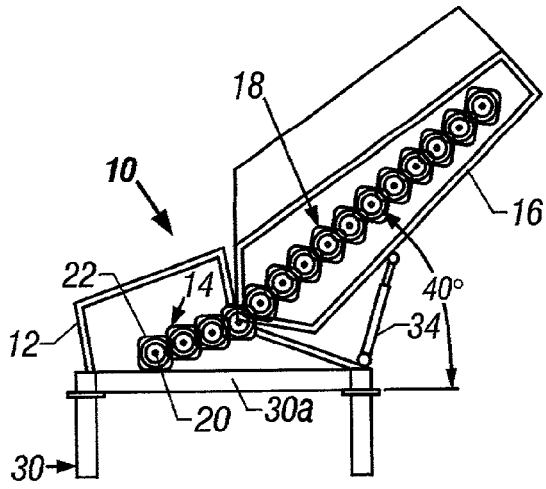
Figure 1C:
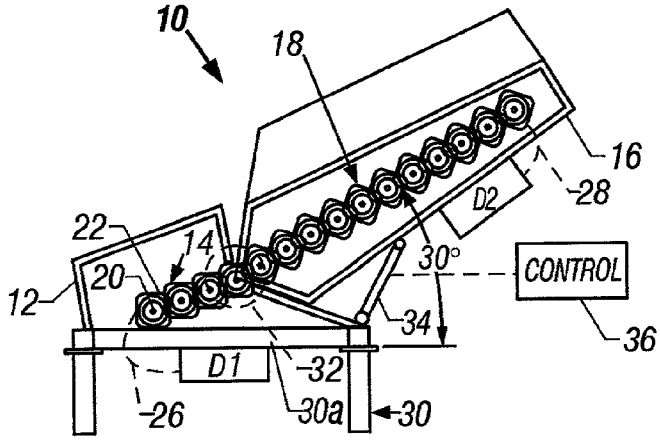

Referring to FIGS. 1A–1C, a first embodiment of the present invention comprises a recycling apparatus 10 that is essentially a single continuous waste classifying screen having end-to-end upstream and downstream sections. The apparatus 10 separates a stream of mixed recyclable materials of various sizes and shapes, including newspaper, clean mixed paper, magazines, plastic bottles, glass bottles and jars, cans, and the like. The apparatus includes a fixed first frame 12 that supports a first inclined disc screen section 14, and an articulating second frame 16 that supports a second inclined disc screen section 18. Each disc screen section, such as 14, is comprised of a plurality of shafts 20 (FIG. 1A) whose axes are spaced apart and parallel, and extend laterally between opposite sides of the frame 12. The shafts are located at progressively greater heights spaced along the longitudinal conveying direction (from left to right in FIG. 1A).

The frames 12 and 16 are each enclosures formed of welded and/or bolted together steel plates. The frames 12 and 16 have solid walls for safety reasons, although they may comprise open frameworks. Each shaft preferably has a square cross section and its opposite ends are journaled in bearings (not illustrated) supported by respective sides of the frames.

Each of the disc screen sections, such as 18 (FIG. 1B), further includes a plurality of discs 22. The discs 22 on each shaft 20 are mounted along the shaft at predetermined laterally spaced intervals. The discs 22 on each shaft 20 are interleaved with, and overlap in the longitudinal direction (left to right in FIG. 1B) with the discs 22 on the adjacent shafts.

While the discs 22 are referred to "discs" they preferably have an irregular outer contour or shape so that when all of the shafts 20 of a screen section, such as 14, are rotated in the same direction, mixed recyclable materials deposited thereon will be agitated and moved along in a conveying direction. In accordance with well know techniques, the spacing of the discs 22 and the resulting dimensions of the openings therebetween determines the size of the materials that will fall downwardly between the discs 22.

Further details of the construction of the disc screen sections 14 and 18 and their discs are set forth in U.S. Pat. No. 6,250,478 granted to Robert M. Davis on Jun. 26, 2001 and entitled "Stepped Disc Screen sections of Unequal Inclination Angles for Conveying and Grading Recycling Materials," the entire disclosure of which is specifically incorporated herein by reference.

Referring again to FIG. 1B, the first disc screen section 14 has a generally planar configuration, i.e., the axes of its shafts 22 generally extend in a common plane. The disc screen section 14 is slightly inclined from an input end on the left side of FIG. 1B to an output end on the right side thereof A drive D1 (FIG. 1C) including a suitable motor rotates the shafts 20 and the discs 22 of first disc screen section 14 in a common clockwise direction in FIG. 1C for moving the mixed recyclable materials along an inclined conveying direction. Mixed recyclable materials are deposited onto the lower input end of the first screen section 14 by a conveyor 24 shown in phantom lines in FIG. 1A. The drive D1 rotates the discs 22 of the first disc screen section 14 via a drive linkage shown diagrammatically as a dashed line 26 in FIG. 1C. The drive linkage 26 may include gears, belts, other suitable drive means well known in the art. Typically the shafts 22 of the disc screen section 14 are driven by a chain and sprocket drive (not illustrated).

Initially the stream of mixed recyclable materials from the conveyor 24 pours onto the lower input end of the first disc screen section 14. As the discs 22 of the first disc screen section 14 rotate, they agitate the mixed recyclable materials which have been deposited onto the same by the first disc screen section 14. Cans and other smaller remaining articles fall through the discs 22 of the first disc screen section 14 into a collection bin (not illustrated) or onto a conveyor (not illustrated). Larger articles such as plastic milk bottles, large soda pop bottles and other mixed containers roll backward and fall off the lower end of the first disc screen section 14 into another collection bin (not illustrated) or onto another conveyor (not illustrated).

The second disc screen section 18 also has a generally planar configuration and preferably has more shafts than the first disc screen section 14. The discs 22 of the second disc screen section 18 are driven by another drive D2 (FIG. 1C) through another drive linkage 28, and are configured and spaced to further divide the remaining material that is conveyed to the lower input end of the second disc screen section 18 into one or more portions that fall through the second disc screen section 18 into other collection bins or onto other conveyors (not illustrated). The remainder of the mixed recyclable materials, which is predominantly newspaper and/or clean mixed paper in this example, is conveyed upwardly to the right along the second disc screen section 18 where it tumbles off of the upper output end thereof into another collection bin (not illustrated) or onto another conveyor (not illustrated).

The shafts 20 of the second disc screen section 18 (FIG. 1C) also extend in a common plane. The second disc screen section 18 can be inclined at different angles relative to the first disc screen section 14. The spacing of the discs 22 of the second disc screen section 18 and the angle of inclination of the disc screen section 18 are carefully selected so that newspaper and/or clean mixed paper will be conveyed off of the upper output end of the second disc screen section 18 on the right side of FIG. 1C. Persons skilled in the art of designing apparatus for classifying a stream of mixed recyclable materials will appreciate that the disc spacings, angles of inclination, and rotational speeds of the recycling apparatus 10 are selected to ensure that two disc screen sections 14 and 18 will optimally classify and sort the input stream of mixed recyclable materials into its various portions or components to achieve the highest percentage or degree of homogeneity of the portions. By way of example, the rotational speed of the shafts 20 of the first disc screen section 14 may be around sixty to one hundred revolutions per minute and the rotational speed of the shafts 20 of the second disc screen section 18 may be between approximately two hundred and three hundred revolutions per minute.

The frames 12 and 16 of the first and second disc screen sections 14 and 18, respectively, are carried by a stand 30. The lower input end of the frame 16 is pivotally mounted to the upper output end of the frame 12 by a hinge, axle, bearing or other suitable pivot means shown diagrammatically as a phantom line circle 32 in FIG. 1C. Preferably the frame 16 is pivoted about the highest shaft 20 of the first disc screen section 14. A hydraulic cylinder 34 has its lower end pivotally mounted to the stand 30 and its upper end pivotally mounted to the underside of the frame 16 that supports the second disc screen section 18. The hydraulic cylinder 34 may be selectively extended and retracted via control 36 to change the angle of inclination of the second disc screen section 18 relative to the first disc screen section. Other means of selectively adjusting the angle of inclination besides the hydraulic cylinder include a powered screw gear jack, a powered pinion and spur gear assembly, cable lifts, chain lifts, pneumatic bags and cylinders, and any other mechanical lifting or pivot inducing mechanism normally used with heavy machinery. These mechanisms could be powered with an electric motor, hydraulic fluid, or other power source or they could be manually actuated, such as with a crank arm or a lever.

The first frame 12 and second frame 16 have complementary mating surfaces 12*a* and 16*a* (FIG. 1A) that limit the range of articulation of the second frame 16 relative to the first frame 12. In FIG. 1A the plane of the disc screen section 18 is positioned at a fifty degree angle relative to the main horizontal members 30*a* of the stand 30. In this state, the single deck formed by the first and second disc screen sections 14 and 18 has a so-called "hockey stick" configuration. In FIG. 1B the plane of the disc screen section 18 is positioned at a forty degree angle relative to the main horizontal members 30*a* of the stand 30. In FIG. 1C the plane of the disc screen section 18 is positioned at a thirty degree angle relative to the main horizontal members 30*a* of the stand 30. In this orientation, the second disc screen section 18 extends at the same angle as the first disc screen section 14 so that they form one continuous planar classifying disc screen.

Figure 2A:
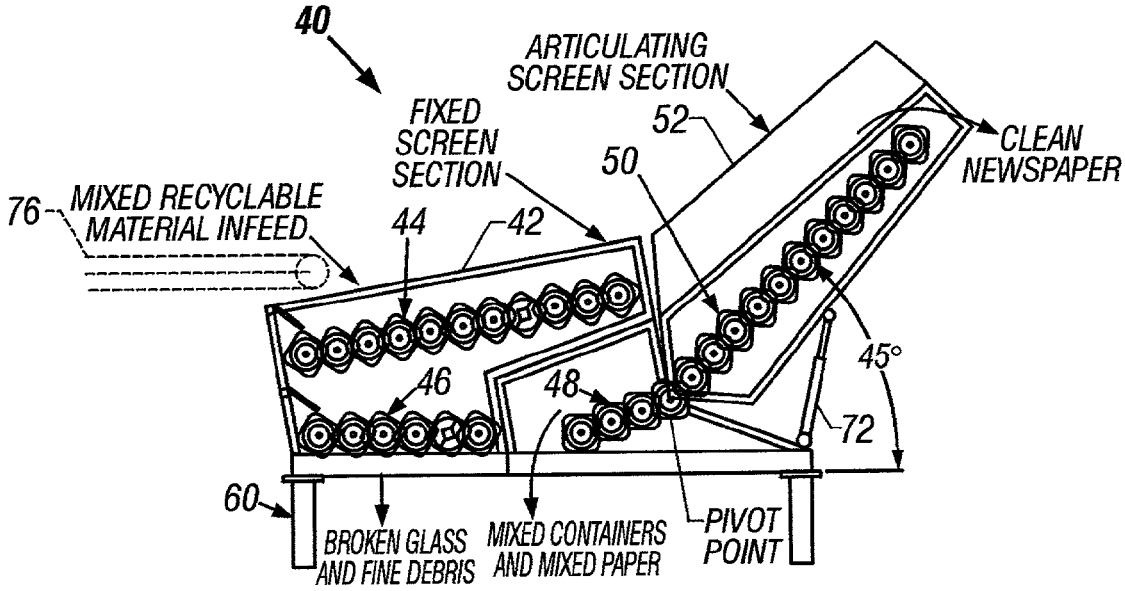
FIGS. 2A and 2B are a pair of diagrammatic cut away side elevation views illustrating a recycling apparatus in accordance with a second embodiment of the present invention showing its downstream articulating disc screen section in two different angular orientations relative to its fixed upstream portion having a pair of overlapping fixed disc screen sections.
Figure 2B:
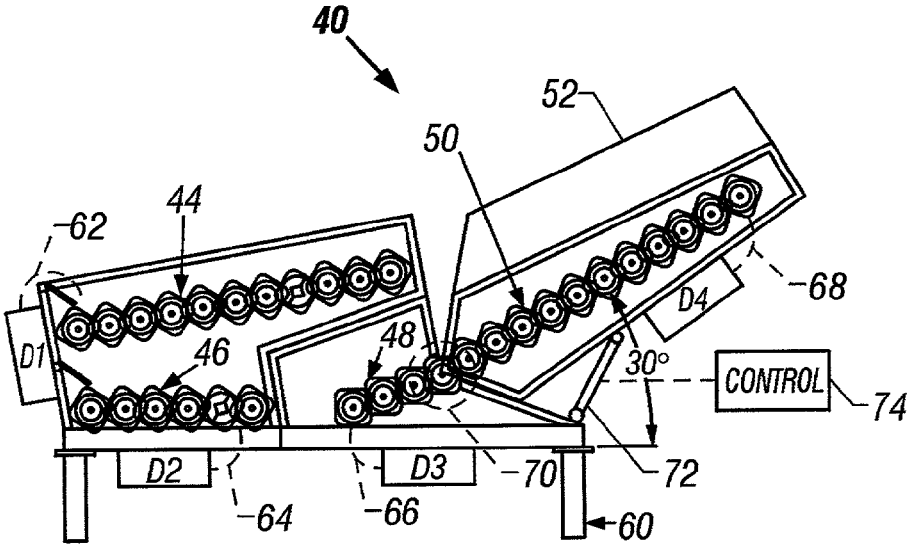

FIGS. 2A and 2B are a pair of diagrammatic cut away side elevation views illustrating a recycling apparatus 40 in accordance with a second embodiment of the present invention. The apparatus 40 includes a first fixed frame 42 that supports a slightly inclined first disc screen section 44 which overlaps a horizontal second disc screen section 46 and an inclined third disc screen section 48. An inclined fourth disc screen section 50 is supported by a second articulating frame 52. As with the apparatus 10, each disc screen section of the apparatus 40 is comprised of a plurality of shafts whose axes are spaced apart and parallel, and extend laterally between opposite sides of its corresponding frame 12. The shafts of each disc screen section extend in generally co-planar relation.

The frames 42 and 52 are carried by a stand 60. The discs of the disc screen sections 44, 46, 48 and 50 are driven by drives D1, D2, D3 and D4, respectively (FIG. 2B) through respective drive linkages illustrated diagrammatically as phantom lines 62, 64, 66 and 68 respectively. The lower input end of the frame 52 is pivotally mounted to the upper output end of the frame 42 by a hinge, axle, bearing or other suitable pivot means shown diagrammatically as a phantom line circle 70 in FIG. 2B. Preferably the highest shaft in the disc screen section 48 provides the pivot. A hydraulic cylinder 72 has its lower end pivotally mounted to the stand 60 and its upper end pivotally mounted to the underside of the frame 52 that supports the fourth disc screen section 50. The hydraulic cylinder 72 may be selectively extended and retracted via control 74 to change the angle of inclination of the fourth disc screen section 50 relative to the third disc screen section 48. Other means of selectively adjusting the angle of inclination besides the hydraulic cylinder could be utilized as described above in connection with the apparatus 10.

Mixed recyclable materials are conveyed onto a lower input end of the first disc screen section 44 by a conveyor 76 illustrated in FIG. 2A in phantom lines. The discs of the of the second disc screen section 46 are closely spaced so that fine debris, such as broken glass, falls through the second disc screen section 46 into a collection bin (not illustrated) or onto another conveyor (not illustrated). Mixed containers and mixed paper fall off the lower end of the third disc screen section 48 into a collection bin (not illustrated) or onto a conveyor (not illustrated). Newspaper and/or clean mixed paper is carried over the upper end of the fourth disc screen section 50.

So in one form my invention comprises a single disc screen having a fixed segment or section and an articulating segment or section. There is no gap between the sections and all of the shafts of the deck can be driven by a common motor and drive linkage. The benefits of articulating a single disc screen intermediate its length will be appreciated by those skilled in the art.

The input end of the second disc screen section 18 should be immediately adjacent to the output end of the first disc screen section 14 for continuously receiving a portion of the recyclable materials. In other words, the two disc screen sections 14 and 18 are capable of forming a single planar disc screen when the second disc screen section 18 is rotated to a predetermined angle of inclination matching that of the first disc screen section 14.

The present invention also provides a method of classifying mixed recyclable materials containing paper and containers. In accordance with the first step of the method, a single continuous inclined disc screen is provided having a plurality of discs 22 with irregular outer contours which are supported on parallel shafts 20 spaced along a conveying direction. The shafts 20 are rotated and mixed recyclable materials are deposited onto the rotating discs 22. An angle of inclination of a downstream section 18 of the disc screen is adjusted relative to an upstream section 14 of the disc screen in order to ensure that mostly containers fall off an input end of the disc screen and mostly paper falls off an output end of the disc screen.

While I have described two different embodiments of a recycling apparatus in accordance with the present invention, variations and modifications thereof will occur to those skilled in the art. For example, air manifolds could be installed above the disc screen sections for pinning clean mixed paper and/or newspaper to the discs 22 as disclosed in my U.S. patent application Ser. No. 09/882,667 filed Jun. 15, 2001, now U.S. Pat. No. 6,460,706 B1, the entire disclosure of which is specifically incorporated herein by reference. The shafts of the two disc screen sections 14 and 18 of the apparatus 10 could be driven by the same motor and common drive linkage. The same is true of the third disc screen section 48 and fourth disc screen section 50 of the apparatus 40. The articulating frame 16 need not be pivotally mounted to the fixed frame 12 but could instead be pivotally mounted to the stand 30 or some other structure. The single deck formed by the disc screen sections 14 and 18 could be modified so that the angle of inclination of each section could be independently adjusted. Therefore, the protection afforded my invention should only be limited in accordance with the scope of the following claims.

What is claimed is:

1. A recycling apparatus, comprising:

a first frame;

a first disc screen section including a plurality of laterally extending first shafts rotatably mounted in the first frame and spaced along a longitudinal conveying direction, first drive means for rotating the first shafts, and a plurality of first discs mounted on the first shafts, the first discs being dimensioned, configured and spaced for classifying a stream of mixed recyclable materials deposited onto the first discs as the first discs are rotated by the first drive means to convey a first portion of the stream along the conveying direction to a first end of the first disc screen section;

a second frame positioned adjacent to the first frame;

a second disc screen section having a first end immediately adjacent to the first end of the first disc screen section and including a plurality of laterally extending second shafts rotatably mounted in the second frame and spaced along the longitudinal conveying direction, second drive means for rotating the second shafts, and a plurality of second discs mounted on the second shafts, the second discs being dimensioned, configured and spaced for classifying the first portion of the stream of mixed recyclable materials deposited onto the second discs from the first disc screen section as the second discs are rotated by the second drive means to convey a second portion of the stream along the conveying direction; and means for selectively adjusting a second angle of inclination of the second disc screen section relative to the first disc screen section without changing a first angle of inclination of the first disc screen section.

2. The recycling apparatus of claim 1 and further comprising means for pivotally connecting the second frame to the first frame.

3. The recycling apparatus of claim 2 wherein the means for pivotally connecting the second frame to the first frame includes an uppermost one of the first shafts.

4. The recycling apparatus of claim 1 wherein the means for selectively adjusting the second angle of inclination of the second disc screen section includes a hydraulic cylinder.

5. The recycling apparatus of claim 1 wherein the first frame and the second frame have complementary mating surfaces that limit a range of articulation of the second frame relative to the first frame.

6. The recycling apparatus of claim 1 wherein the first frame further includes a third frame and a third disc screen section including a plurality of laterally extending third shafts rotatably mounted in the third frame and spaced along a second longitudinal conveying direction, third drive means for rotating the third shafts, and a plurality of third discs mounted on the third shafts, the third discs being dimensioned, configured and spaced for classifying a third portion of the stream of mixed recyclable materials deposited onto the third discs.

7. The recycling apparatus of claim 1 and further comprising a stand for supporting the first and second frames.

8. The recycling apparatus of claim 1 wherein the frames are formed of steel plates.

9. The recycling apparatus of claim 1 wherein the first and second disc screen sections are positioned end-to-end to form a single continuous classifying deck.

10. The recycling apparatus of claim 1 wherein the first and second drive means share a common motor and drive linkage.

11. A classifying apparatus, comprising:

a disc screen including a plurality of interleaved discs supported on shafts spaced along a conveying direction, a first frame rotatably supporting a first portion of the shafts to define a first section of the disc screen, a second frame rotatably supporting a second portion of the shafts to define a second section of the disc screen, and means for pivotally mounting the second frame relative to the first frame;

at least one drive and drive linkage that rotates the shafts;

the discs having an outer contour shaped for agitating materials deposited onto the disc screen and for carrying at least a portion of the materials along the conveying direction when the discs are rotated in a common predetermined direction by the drive and drive linkage; and means for independently adjusting an angle of inclination of each disc screen section in order to improve the separation of materials deposited onto the disc screen.

12. The apparatus of claim 11 wherein the first frame and the second frame are carried by a stand.

13. The apparatus of claim 11 wherein the frames have complementary mating surfaces that limit a range of articulation of the second frame relative to the first frame.

14. The apparatus of claim 11 wherein the shafts of the first section are rotated by a first drive and a first drive linkage and the shafts of the second section are rotated by a second drive and a second drive linkage.

15. The apparatus of claim 11 wherein the discs of the first section having a first spacing that is different than a second spacing of the discs of the second section.

16. The apparatus of claim 11 wherein the first and second sections are positioned end-to-end to form a single continuous classifying deck.

17. The apparatus of claim 11 wherein the discs of the first and second sections are rotated by a common motor and drive linkage.

18. The apparatus of claim 11 wherein the means for pivotally mounting the second frame to the first frame includes a shaft of the first section.

* * * * *